US006330998B1

(12) United States Patent
Roy

(10) Patent No.: US 6,330,998 B1
(45) **Date of Patent: *Dec. 18, 2001**

(54) PLASTIC SHEATH PRODUCTS FOR STUDDED STEEL T-POSTS, AND PRODUCTION

(75) Inventor: Christopher H. W. Roy, Drury, MO (US)

(73) Assignee: Outdoor Technologies, L.L.C., Drury, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/436,312

(22) Filed: Nov. 8, 1999

Related U.S. Application Data

(60) Provisional application No. 60/132,775, filed on May 6, 1999.

(51) Int. Cl.[7] ..... E04H 17/10

(52) U.S. Cl. ..... 256/19; 256/59; 256/60; 256/65; 256/66

(58) Field of Search ..... 256/59, 60, 65, 256/66, 2, 9, 6, 10, 19; 40/606, 607

(56) References Cited

U.S. PATENT DOCUMENTS

| | | | | |
|---|---|---|---|---|
| D. 269,209 | | 5/1983 | Hegarty | D25/131 |
| D. 349,164 | | 7/1994 | Fox | D25/38 |
| D. 385,678 | | 10/1997 | Fitzgerald et al. | D99/29 |
| D. 416,335 | * | 11/1999 | Roy | D25/131 |
| 813,782 | | 2/1906 | Eade | 256/10 |
| 2,814,071 | | 11/1957 | Allan et al. | 18/14 |
| 3,776,522 | * | 12/1973 | Bartlett | 256/47 |
| 3,963,403 | | 6/1976 | Hughes et al. | 425/325 |
| 4,070,007 | * | 1/1978 | Minor et al. | 256/19 |
| 4,357,001 | * | 11/1982 | Schmanski et al. | 256/51 |
| 4,404,785 | | 9/1983 | McCracken et al. | 52/290 |
| 4,516,756 | | 5/1985 | Beatty | 256/1 |
| 4,520,231 | * | 5/1985 | Hubbell | 256/10 |
| 4,623,756 | * | 11/1986 | Wilson, Jr. | 256/10 |
| 4,680,428 | * | 7/1987 | Wilson, Jr. | 256/10 |
| 4,948,099 | | 8/1990 | Brand et al. | 256/47 |
| 4,983,347 | | 1/1991 | Rahn | 264/508 |
| 5,364,076 | | 11/1994 | Nicholls | 256/22 |
| 5,395,093 | | 3/1995 | Chrisman | 256/47 |
| 5,518,333 | * | 5/1996 | Ceinkus, Jr. et al. | 256/65 |
| 5,856,875 | * | 9/1999 | Aughenbaugh | 256/48 |
| 5,870,921 | | 2/1999 | Piccinin et al. | 72/269 |
| 6,039,308 | * | 3/2000 | Venegas, Jr. | 256/65 |

* cited by examiner

*Primary Examiner*—Lynne H. Browne
*Assistant Examiner*—Doug Hutton
(74) *Attorney, Agent, or Firm*—Jonathan A. Bay

(57) ABSTRACT

An extruded plastic sheath product is provided to cover studded steel T-posts and hence give fence lines or sign posts and improved, even aesthetic appearances. The plastic sheath product is formed with a series of internal projections which abut against features of the internal T-post and hence prevent the sheath from spinning about the T-post. For the fence line filed of use, the plastic sheath product is further given an external spine which has formations or else studs formed in it to prevent fence wire strapped to the sheath from slipping. For the sign post field of use, the sheath is further provided with a series of coupling accessories in order to construct frames and the like. Such coupling accessories optionally include Ell's, Tee's, crosses, or y-shaped splitters. The shape and arrangement of the extruded tubular sheath is especially designed to accommodate certain shape anomalies which result from the extrusion process.

16 Claims, 8 Drawing Sheets

PLASTIC SHEATH PRODUCTS FOR STUDDED STEEL T-POSTS, AND PRODUCTION

CROSS-REFERENCE TO RELATED APPLICATION(S)

This application claims the benefit of U.S. Design Patent Application No. 29/100,660, filed Feb. 12, 1999, and U.S. Provisional Patent Application No. 60/132,775, filed May 6, 1999.

BACKGROUND OF THE INVENTION

1. Field of the Invention

The invention relates to conventional studded steel T-posts and more particularly to inventive plastic sheath products for decoratively covering such studded steel T-posts. Typically the plastic sheath products are combined with studded steel T-posts to dress up fence lines and the like. However the plastic sheath products are equally suitable for use with the T-posts in sign post arrangements and even allow T-posts to be used in environments where to date T-posts have been considered too casual. The invention also relates to accessory products for rigging the plastic sheath products up as sign posts, mailbox posts and so on. The invention moreover relates to the production of such plastic sheath products by extrusion from thermoplastic material.

A number of additional features and objects will be apparent in connection with the following discussion of preferred embodiments and examples.

2. Prior Art

Studded steel T-posts have long been available for use as fence posts and sign posts and the like. In use as fence posts, studded steel-T posts typically measure several feet high and are relatively slender. A standard size of studded steel T-posts in accordance with the prior art (see, eg., FIG. 15) will insert inside a nominal 1½ inch (3.8 cm) diameter hole. Obvious as it sounds to say, studded steel T-posts generally have a T-shaped cross-section. More accurately, however, studded steel T-posts have a "haunched" (ie., a term of art) flange T-shape.

To turn ahead to FIG. 15, it shows a representative cross-section of a given studded steel T-post 35 in accordance with the prior art. This cross-section is representative of a very common standard size that is widely commercially available. The studded steel T-post 35 generally has a T-shaped cross-section except that, more accurately, the flange 39 is "haunched" to give the "Tee" greater depth in the stem-wise direction and hence a greater bend-resisting moment. Thus the studded steel T-post 35 has a stem portion 37 extending between a base edge 41 and an insertion 42 in a belly 43 of the haunched flange 39. Opposite the belly 43 of the haunched flange 37 is a dorsal side 44. Also the flange 39 comprises opposite left and right eaves or haunch portions 45,46 which extend from their origins 45' and 46' in the stem insertion 42 to their own respective free edges 47. Extending down the lengthwise axial run of the dorsal side 44 is a crown row (eg., 48) of a series of generally triangular, uniformly spaced studs 48. The appearance of this crown row of studs 48 is better shown by FIG. 1. Typically the spacing between the studs 48 might measure about 2¼ inches (5.7 cm) between centers.

In a fence line 30 as shown by FIG. 1, the studded steel T-posts 35 are most often used with steel (or aluminum) fence wire 32 to construct wire fences. FIG. 1 shows more particularly a barbed wire fence 30 comprising three courses of barbed wire 32 disposed at respectively different heights. The barbed wire 32 courses can be easily strapped to the studded steel T-posts 35 at the respective heights therefor by wire strapping 33. The studs 48 of the T-posts 35 prevent the fence wire 32 and wire strapping 33 from slipping on the T-post 35, thereby positively locating the fence wire 32 at a desired height from the ground.

The T-configuration of the T-posts 35 causes the posts 35 to be extremely strong against bending. Accordingly, studded steel T-posts have gained wide acceptance as strong, long-lasting posts for use in constructing wire fencing as well as for use as sign posts.

A major market for T-post fence lines includes fencing in pastures for containing livestock such as cattle and horses. Installation of a T-post fence line affords many advantages over other post systems. T-posts can be simply hammered into the ground without a dug hole. To do this there is a special hammering device (not shown) in the form of a closed-top tube that slides over the top of the T-post. A typical hammering device has a pair of lobed handles that allows a user to slide the hammering device up and down over the T-post. The down stroke is the hammering stroke. The T-post is likely formed with a pointy bottom and is also likely to carry and an attached spade-shaped foot near its bottom (neither shown) to stabilize the T-post in the ground. Cattle in particular have the habit of leaning heavily against fence lines (even barbed wire fence lines) to stretch out over the fence where possible and graze on the opposite side. T-posts are ideal for withstanding this sort of abuse because the spade-shaped foot buried in the ground firmly braces the anchorage of the T-post against toppling over and the T-shape itself is highly resistant to bending.

T-posts are also coated with rust inhibitors. Hence their wear life is virtually indefinite and compares very favorably to the other materials most commonly used as post material. In view of the foregoing, the advantages of T-post fence lines are manifold. Installation is relatively simple. Hole digging is usually needless, as are concrete footings. T-posts are relatively lightweight and a single worker can carry one about the site without any hoisting equipment (as would be necessary for, say, concrete posts). T-posts are economical, strong and durable as well as, moreover, afford not only easy installation but also prospectively easy removal at some indefinite date after installation.

There are shortcomings associated with T-post fence lines. Some property owners find T-post fence lines as being drab if not unsightly. This is especially true for the growing number of property owners who do not derive the major (if any) portion of their income from the property they fence in. For example, many of the farms surrounding towns and the suburban belts of small cities are owned by person who derive the majority of their wealth from jobs or sources other than managing the farm property. Owning the farm is more important for pride in the ownership than for deriving an income. It is not true to characterize such property owners as a class of "wealthy" or "absentee" landholders as many must work at their other jobs to financially support the ownership of their farms. It is somewhat true however that these property owners find light farm work as an ideal way to unwind from the pressures of their jobs. They are also likely to see their land not so much as a mere farm but more as an extension of a grand lawn. It has been observed that more and more owners of fields and pastures are desiring to fence in these properties with dressed up fence lines. Some may have truly deep pockets, in which case they can consider wood or perhaps stone materials in their fencing. But for most, stone and wood materials are beyond their means. Nevertheless the aptly utilitarian T-post fence may not perfectly suit their desire to dress up their fence line.

Truly some fields and pastures can be expansive. Any desire to dress up such a fence line can also involve substantial expense. For instance, wood fences involve expensive materials requiring both laborious and expensive installation as well as requiring expensive maintenance and periodic replacement. Decorative stone or concrete fences can cost even more.

What is needed is an improvement which overcomes the shortcomings of the prior art and affords property owners a relatively affordable as well as decorative option for dressing up fence lines, which can be simply installed without entailing expensive maintenance, and all while without detracting from the strength or durability of studded steel T-post fence lines.

SUMMARY OF THE INVENTION

It is an object of the invention to provide an extruded plastic sheath product to cover a studded steel T-post and hence improve appearances.

It is an additional object of the invention to arrange the above plastic sheath product with a series of internal projections which abut against features of the internal T-post and hence prevent the sheath from spinning about the T-post.

It is an alternate object of the invention to arrange the above plastic sheath product with an external spine which prevents fence wire strapped to the sheath from slipping.

It is a further object of the invention to produce a series of coupling accessories for the extruded plastic sheath, including perhaps Ell's, Tee's, crosses, or y-shaped splitters. Such coupling accessories will allow adapting the T-post and sheath combination for use as a sign post in any number of arrangements.

These and other aspects and objects are provided according to the invention in a combination studded steel T-post and an extruded plastic sheath for covering the studded steel T-post. The studded steel T-post generally has a T-shaped cross-section defined by a stem and a haunched flange having a belly side and a dorsal side. The stem inserts into the belly side of the haunched flange. The flange has opposite eave portions which extend from origins in the stem insertion to respective free edges. Extending down the lengthwise axial run of the dorsal side there is formed a row of generally uniformly spaced studs.

In combination with that is the extruded plastic sheath. It has a generally uniform cross-section comprising a tubular wall having inner and outer sides and surrounding a main hollow-core sized sufficiently large to allow the T-post to slide axially inside thereof. The tubular wall includes a series of internal projections which project into the hollow-core from origins on the inner side of the tubular wall. Preferably these set of projections include at least a stud-slideway formation which defines a close-fitting slideway for the spine of studs. Optionally the projections further include at least one of the following if not both. That is, optionally the other projection(s) might include a stem-slideway formation which defines a close-fitting slideway for the stem of the T-post, wherein this stem-slideway formation is generally located diametrically opposite the stud-slideway means. Alternatively, the projections might include a pair of generally opposed eave-guiding formations disposed diametrically transverse to the stud-slideway formations and for guiding the belly sides of the opposite eaves. Typically these formations take the format of flat planar rails.

Another aspect of the invention includes that since a T-posts generally have a commercially standard wherein they are capable of sliding inside nominally a 1½ inch (3.8 cm) diameter hole, then the sheath is accordingly sized such that the inner side of the tube wall defines a nominally round conduit having an inside diameter between about at least 5 and 10% greater than a nominal measure of 1½ inches (3.8 cm).

However, there is no requirement that the tube wall be nominally round. For example, another contemplated shape is arrowhead shaped. Other shapes are possible and the depiction in the drawings of round or arrowhead shapes only is done for convenience of brevity only and is not meant to limit the invention to these shapes only.

The plastic sheath optionally includes an external formation on the outer side of the tubular wall for preventing axial slipping of fence wire strapped to the sheath. This external means formation is preferably generally directly outside the tubular wall from the stud-slideway formations. The external formation can take the format of an extruded spine on the outer side of the tubular wall, wherein the spine is further formed with slip-prevention formations for preventing axial slipping of fence wire strapped to the sheath. These slip-prevention formations might be given the form of either a series of notches or a series of studs and so on.

A further aspect of the invention includes the provision of a series of coupling accessories for the extruded plastic sheath which might include any of the following:—eg., Ell's, Tee's, crosses, or y-shaped splitters. The advantage of these coupling accessories include that they will allow adapting the T-post and sheath combination for use as a sign post(s) and so on.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIGS. 3 through 6 comprise a series of side elevation views from vantage points each a quarter turn apart around the FIGS. 1 and 2 embodiment of the plastic sheath product in accordance with the invention, wherein:

FIG. 3 is a side elevational view thereof taken from the right of FIG. 2, and in which the cap in this view is shown assembled, FIG. 4 is a side elevational view thereof taken from the right of FIG. 3, FIG. 5 is a side elevational view thereof taken from the right of FIG. 4, and FIG. 6 is a side elevational view thereof taken from the right of FIG. 5;

FIG. 19 is a perspective view in accordance with the prior art of a barbed-wire strung, studded steel T-post fence line where it traverses a shallow ditch dissecting a pasture or the like;

FIG. 24 is a perspective view of various alternate accessories in accordance with the invention for use with the plastic sheath product, such as caps and more especially couplings therefor, including Ell's, Tee's, crosses, and "y"-shaped splitters and so on;

DETAILED DESCRIPTION OF THE PREFERRED EMBODIMENTS

Figure 1:
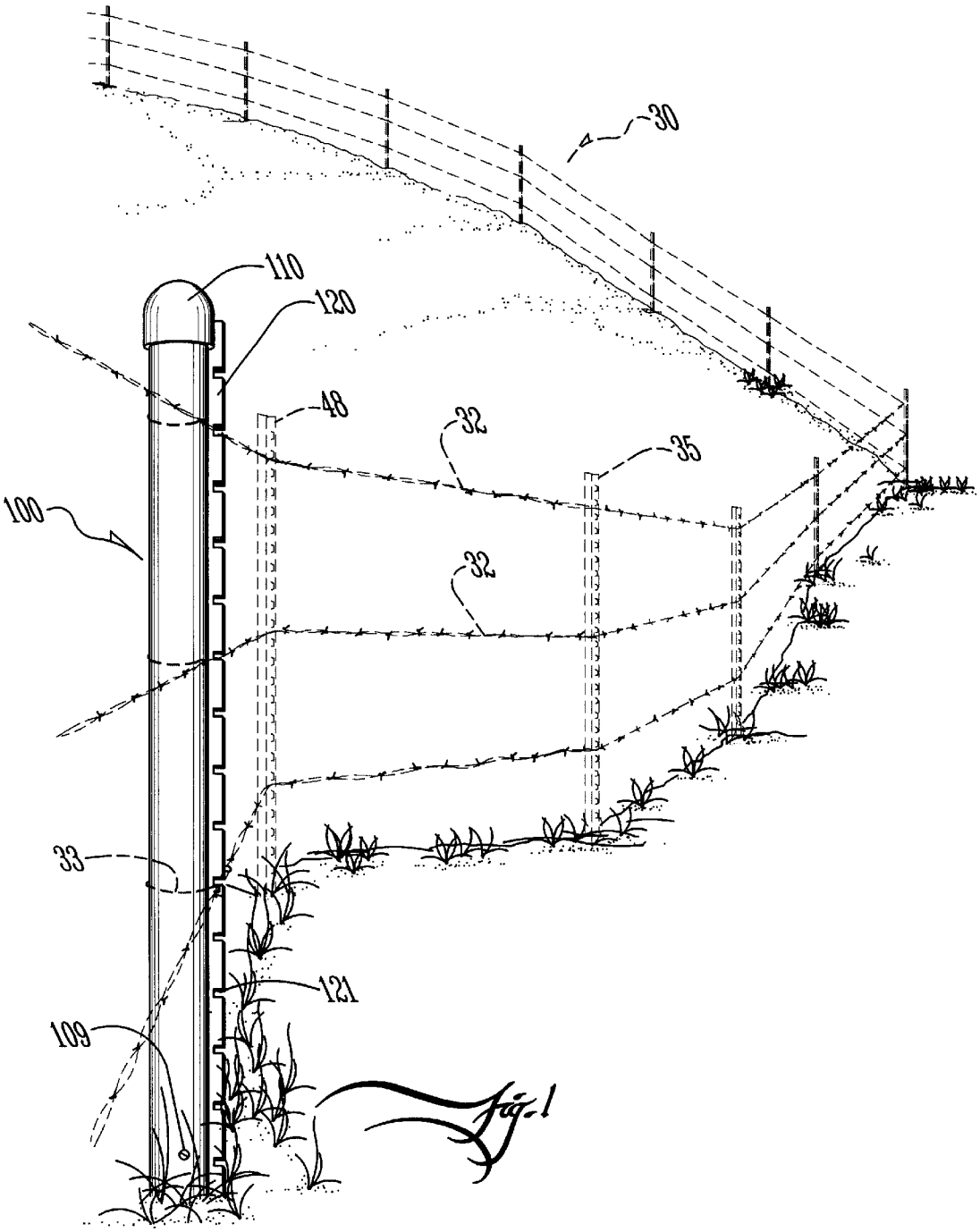
FIG. 1 is a perspective view of a plastic sheath product in accordance with the invention for covering studded steel T-posts, wherein a barbed-wire fence line of uncovered studded steel T-posts is shown in broken lines to illustrate one operative use environment for the invention.
Figure 2:
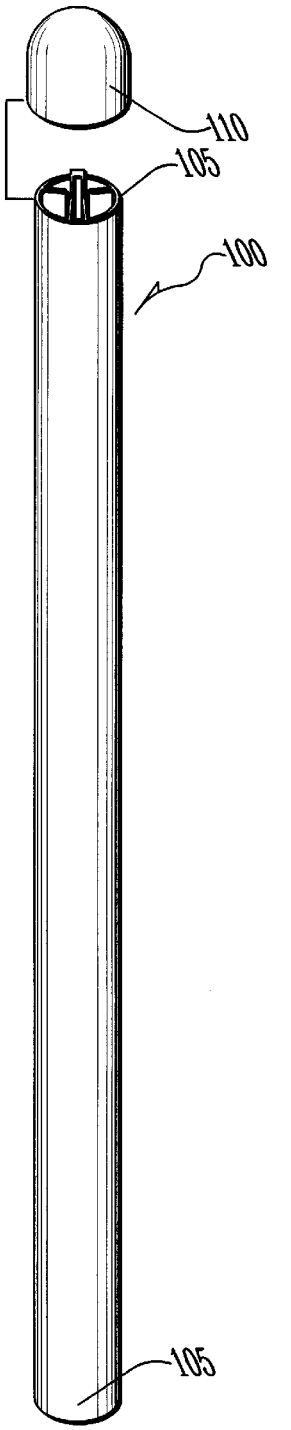
FIG. 2 is an enlarged, exploded perspective view of the plastic sheath product of FIG. 1, as taken from a vantage point to the left thereof, and in isolation from the rest of the fence line which is removed from the view, wherein a plastic cap therefor is shown elevated above the sheath product in a condition of dis-assembly.
Figure 3:
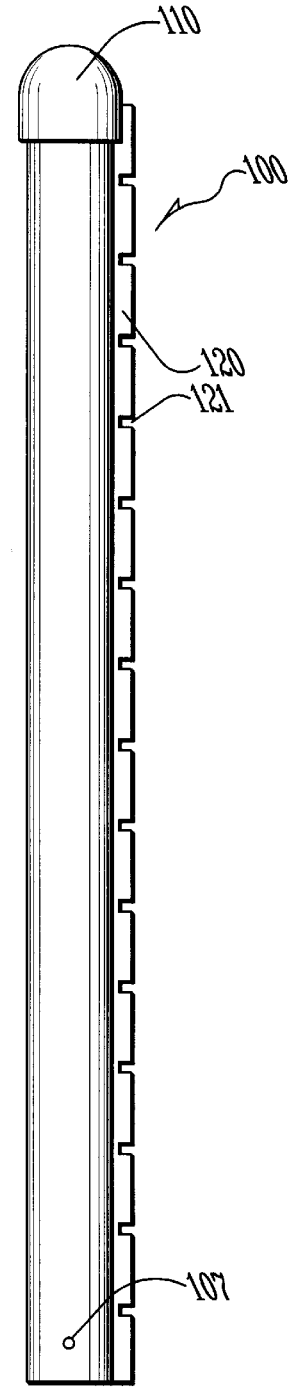
Figure 4:
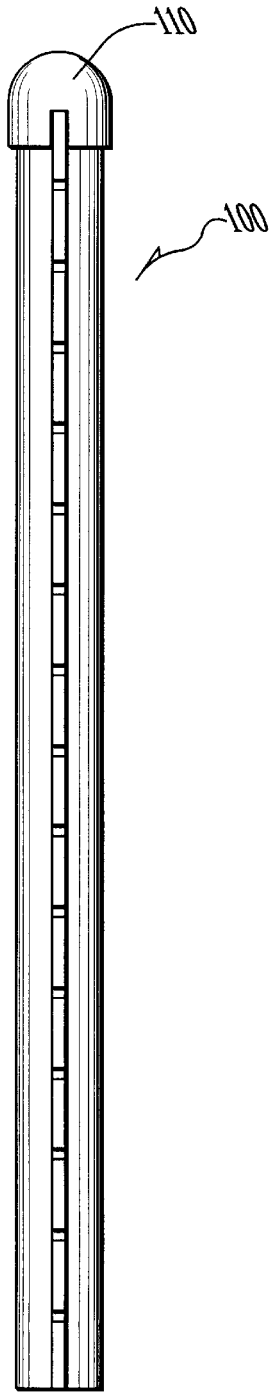

In FIG. 1, a plastic sheath product 100 in accordance with the invention is provided for covering a studded steel T-post 35 which, in this particular use environment, is part of a barbed-wire fence line 30. FIG. 1 shows only one such plastic sheath product 100, as the remaining studded steel T-posts 35 of the fence line 30 are shown uncovered to better illustrate how this operative use environment appears without the inclusion of the invention. It is an inventive aspect that this plastic sheath product 100 that it is produced by extrusion.

With joint reference to FIGS. 1 through 7, the plastic sheath product 100 has a hollow tube form which allows the sheath product 100 to slide over the T-post 35. In use, the T-post 35 is anchored in the ground before the sheath 100 is slid over it. Once the T-post 35 is in place, then a chosen length of the plastic sheath product 100 is slid over the T-post 35. The plastic sheath product 100 has a series of internal projections which are described more particularly below in connection with FIGS. 8 through 14. Those internal projections resist against the plastic sheath product 100 spinning about the T-post 35. The plastic sheath product 100 preferably is pre-drilled near its base with a small hole 107 (see, eg., FIG. 3) for insertion of a self-tapping set screw 109 (see FIG. 1) which is tightened against the internal T-post. The set screw 109 prevents the sheath from sliding up the T-post 35. Also, the plastic sheath product 100 is capped by a plastic cap 110 (see, eg., FIGS. 2, 4 and 7). The cap 110 both completes the ornamental look of the plastic sheath product 100 as well as blocks out rain, debris or nest-making insects.

The plastic sheath product 100 includes an axial ridge or spine 120 that is given a set of notches 121 for retention of the fence wire 32. In this case the notches 121 are uniformly spaced with about 2¼ inches (5.7 cm) between centers. The fence wire 32 is strapped to the plastic sheath product 100 by wire strapping 33 as is known, and the notches 121 retain the fence wire 32 and strapping 33 from slipping.

As previously mentioned, the plastic sheath product 100 is produced by extrusion, and some of the trials experienced in merely advancing to the prototype stage will be more particularly described below. But for now, briefly, the sheath product 100 is extruded from a suitable thermoplastic material, preferably including by way of non-limiting example polyvinyl chloride or the like. The thermoplastic material can be tinted to about any color or hue, and perhaps produced in multi-hue patterns such as axially-running or helically-coiling stripes and the like. Preferably the plastic sheath product 100 is treated to block out UV radiation as by a coating or an additive to the thermoplastic compound as is known in the art. It is presumed that one popular color will be solid white. Nowadays there is fence wire including barbed wire which is coated with a solid white polymeric film (not shown). It is believed that the solid white sheaths 100 in combination with white fence wire will produce a highly appealing aesthetic look which is more often associated with fine wood fences and not wire fences.

The presumed demand for other colors is likely to include purple. In some states by statute, purple-painted markers suffice as a form of posting the property for "No Trespassing." See, eg., R. S. Mo. §569.145. Hence the sheath product 100 is likely to be offered in solid purple so that some or all of the posts of a given stretch of fence line 30 can include a display of purple. Alternatively the sheath product 100 may be offered with a purple stripe extending along the axial length of the sheath product 100 or else in a helical coil around the sheath product 100. Incorporating a purple tint in the sheath product 100 will provide property owners with a more durably colored purple posting as compared against to painting splotches on tree trunks—which is seen often—because the purple paint eventually flakes off the bark as it sheds over a couple of seasons.

FIGS. 8 through 14 show a variety of internal shapes for the plastic sheath product 100. These shapes vary mainly according to the arrangement of internal projections which prevent the plastic sheath product 100 from spinning about the T-post 35. These internal projections guide the differing features of the T-post 35 inside the sheath 100 while the sheath 100 is being slipped over the T-post 35. In most embodiments the guides take the form of flat planar rails.

In use, durably preventing the sheath 100 from spinning about the T-post 35 is especially desirable. That is, as a sign post 100' (see, eg., FIG. 23) the force of wind on the sign 175 acts to torque the sheath 100' about the internal T-post (not in view). Also, in fence lines 30, prevention of spinning is desirable when considering how cattle punish fences and fence posts. As previously mentioned, cattle are known to lean with all their weight against fences to reach over and graze on the other side. The plastic sheath product 100 is designed to withstand this kind of punishment as well as other forms of abuse. The design includes a relatively thick tubular wall 130 (see FIG. 9) that measures about 3/32nds (2.4 mm) inches thick. The internal rails also measure about 3/32nds (2.4 mm) inches thick.

Figure 9:
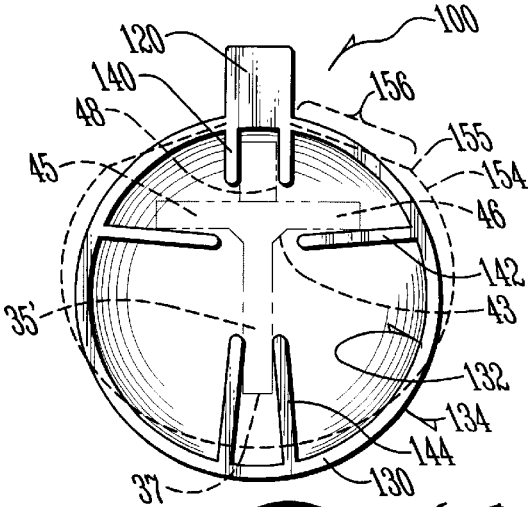
FIG. 9 is an enlarged scale plan view comparable to FIG. 8, except that a stylized studded steel T-post inside thereof is shown in broken lines to illustrate relative scale.

FIG. 9 shows a first embodiment 100 of the invention in an enlarged scale end view. This embodiment 100 has been chosen for a prototype program for which there are plans for field trials. A stylized studded steel T-post 35' is depicted in FIG. 9 in broken lines to illustrate relative scale. The plastic sheath product 100 comprises a main, round tubular wall 130 which extends more or less in a circular loop. The main tubular wall 130 has both inner and outer sides 132 and 134. The outer side 134 includes the formation of the previously mentioned axial spine 120. The inner side 132 defines the main axial hollow-core or "lumen." Also, the inner side 132 is formed with the sets of internal rails. Each rail projects to a free edge inside the lumen from its own origin in the inner side 132 of the tubular wall 130.

The sets of rails shown by FIG. 9 include the following. One pair of rails 140 are arranged generally parallel to each other and cooperatively define a close-fitting slideway for the row of studs 48 of the studded steel T-post 35'. These rails 140 are termed here for sake of convenience in this written description, the "temple" rails. The temple rails 140 are aligned directly inside of the spine 120 on the outer side 134 of the tubular wall 130.

Another pair of rails 142 are arranged in general opposition to each other and are located for guiding the belly sides 43 of the flange haunches (or eaves) 45,46 of the studded steel T-post 35'. These rails 142 are termed here for sake of convenience in this written description the "eave" rails. An additional pair of rails 144 are arranged for defining a close-fitting slideway for the stem 37 of the studded steel T-post 35. For sake of convenience in this written description these rails 144 are denominated here as the "base" rails. These base rails 144 are arranged not so much as parallel but slightly convergent relative to each other. The base rails 144 contact the stem 37 along the margin of its base.

Whereas to date a prototype program is going forward with the design 100 shown by FIG. 9, the series of views in FIGS. 10*a* through 14 show other designs which have been and/or are being considered. The following comments reflect the latest understanding to date of various problems with "shape anomalies" which are encountered in the extruding process, and how these "shape anomaly" problems relate to the various shapes under consideration.

Figure 11:
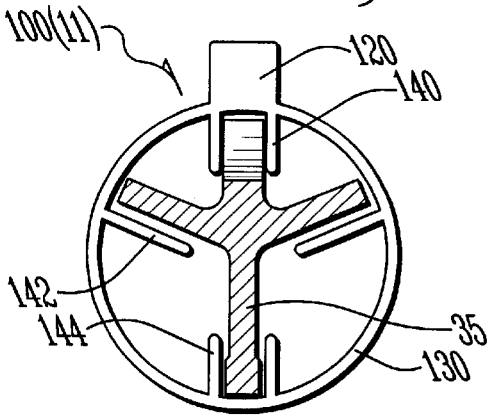
FIG. 11 is a plan view comparable to FIG. 10*a* except of an alternate version of FIG. 9.

More fundamentally, the sheath product 100 has so far proven fiendishly difficult to extrude. Various shape anomalies that have been identified to date include at least axial camber, out-of roundness with the tubular wall, and warped or non-straight rails. FIG. 11 shows an internal shape 100(11) which corresponds to FIG. 9 except that the proposed inside diameter would measure nominally about 1½ inches (3.8 cm). As previously mentioned, an industry-wide standard size for studded steel T-posts in accordance with what is shown by FIG. 11 will insert inside a nominal 1½ inch (3.8 cm) diameter lumen. Thus FIG. 11 proposes scaling the inside diameter of the tubular wall to fit closely around the T-post 35. However, to date a tube cannot be reliably extruded in the design 100(11) shown by FIG. 11 because the integrity of the shape cannot be maintained. More plainly, a nominal 1½ inch (3.8 cm) diameter extruded sheath product 100(11) would not slide over the T-post 35 because of undue binding and/or sticking.

Hence the shape 100(11) shown by FIG. 11 was re-designed in the scale shown by FIG. 9 at least for proceeding forward with a prototype program. The above-mentioned shape anomalies are still encountered but at least the sheath 100 will fit over the T-post 35 without undue binding or sticking.

Figure 5:
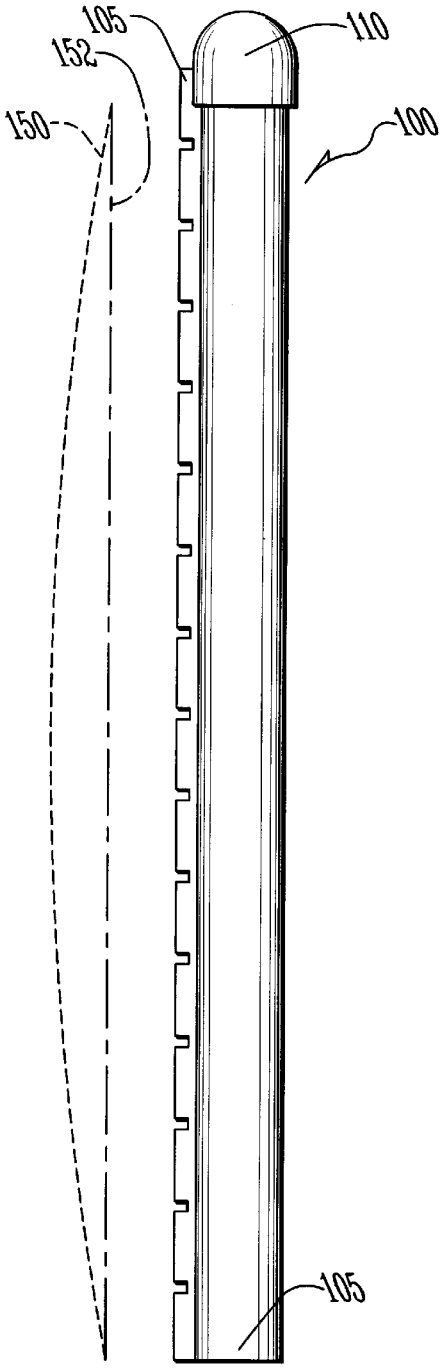
Figure 6:
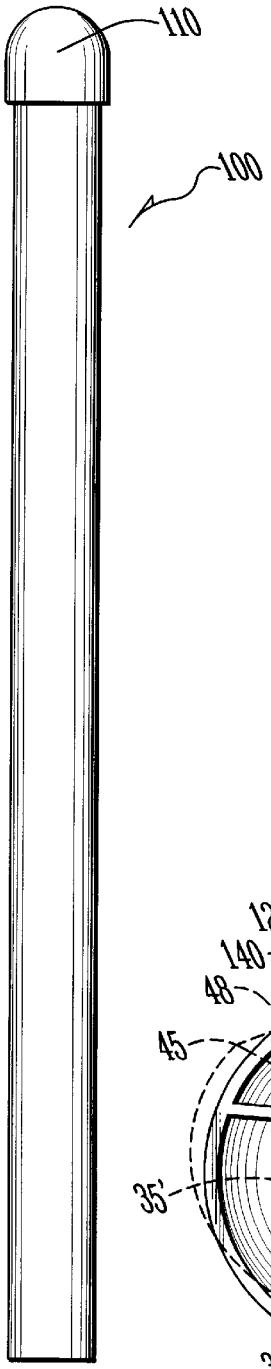
Figure 7:
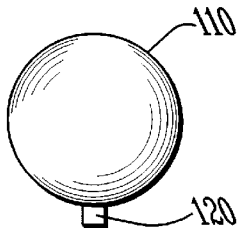
FIG. 7 is a top plan view of FIG. 4.
Figure 8:
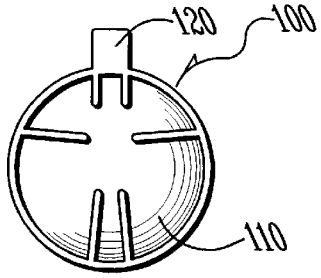
FIG. 8 is a bottom plan of FIG. 7.

One shape anomaly which is noticeable in the extruded tube 100 is axial camber. FIG. 5 includes a stick diagram in which camber is designated by reference numeral 150. That is, camber is depicted in dashed lines by numeral 150, the dot-dash line 152 represents a straight axis for reference of the camber 150 (the extent of the camber is exaggerated). Hence "camber" means that the middle of the tube 100 arches in the direction indicated relative to its ends 105. The cause of camber 150 has been prospectively identified. It evidently arises from differential cooling that occurs across the tube 100 as it exits the extrusion die, and hence from the differential shrinkage that occurs with the differential cooling.

To compare FIGS. 5 and 9, the camber 150 in the tube 100 occurs in the plane that bisects the tube 100 through the spine 120. FIG. 9 in particular shows that the upper third of the tube 100 is formed with the spine 120 and four of the rails 140 and 142. The lower two thirds of the tube 100 is formed with just two rails 144. Hence there is more bulk of plastic material in the upper third of the tube 100 than the lower two thirds. Evidence seems to suggest that the lower two-thirds of the tube 100 cools more rapidly than the bulkier upper third. Hence the lower two-thirds shrinks sooner, and thus slightly curls the tube 100 towards its ends 105 to cause the camber 150 in the run of the spine 120.

Another shape anomaly occurring in the extruded tube 100 concerns the measure of out-of-roundness in the tube wall 130. The appearance of the out-of roundness is shown by dashed lines 154 in FIG. 9 (again, the scale is exaggerated). It is not too surprising that, given the fact of camber 150, the tube wall 130 is not round but sort of oval 154. Practically speaking, it is expected that a bent round tube will flatten into an ellipse such that the minor diameter will lie on the radius of the curvature (eg., in FIG. 9, the axis of the vertical diameter and which contains the spine 120) and the major diameter being transverse thereto (eg., in FIG. 9, the axis of the horizontal diameter). Hence the oval shape 154 is partly expected when given the fact of camber 150.

However, the oval shape 154 seems irregular. That is, the major diameter (eg., in FIG. 9, the diameter which extends horizontally) does not bisect the center of geometry of the tube wall 130. Instead the major diameter seems to shifted up, towards the spine 120. Hence this oval shape 154 as indicated in FIG. 9 might be a compound product both of camber 150 and uneven shrinkage in the tube wall 130. For instance, as FIG. 9 shows, noticeable bulges 155 can be found at the origins of the opposed eave rails 142. The opposite spans of the tube wall indicated as 156 (ie., that flank the spine and extend to the origins of the eave rails) have flattened out considerably, and are almost straight. By design the nominal inside diameter for the tube wall should measure about 2 inches (5.1 cm) in diameter, but the diameter across the spine 120 and the base rails 144 actually measures in fact between about 5 and 10% less.

An additional shape anomaly occurring in the tube 100 is warping in the rails (not depicted in the drawings). It is the eave rails 142 which seem most severely affected. The base rails 144, which are just as elongated and slender, lie parallel to the radius of curvature of the camber 150, and do not seem to warp. But the eave rails 142 lie generally transverse to the radius of curvature of the camber 150. Their origins arch with the camber 150 but otherwise the eave rails 142 are warped like half of a potato chip, and in consequence the free edges of the eave rails 142 exhibit a relatively severe warp.

One aspect of the FIG. 9 embodiment relates to harmonizing the fact of the shape anomalies with the features of the T-post 35 by making the tube 100 over-sized. That is, instead of making the tube with the initially proposed diameter of 1½ inches (3.8 cm), the tube 100 is oversized to a nominal 2 inches (5.1 cm) inside diameter. The extruded tube 100 still exhibits camber, out-of-roundness and warp as discussed above, but nevertheless the tube 100 fits over the T-post 35 in a close-fitting relationship as is desirable.

Given what has been learned about the extrusion of the tubes, the following comments are applicable to the shapes shown by FIGS. 10*a* through 14.

FIG. 11 shows comparably the same internal arrangement as FIG. 9 except in a 1½ inch (3.8 cm) diameter version. Given the present lack of mastery over eliminating the identified shape anomalies, this design 100(11) is likely problematical. To prove workable the nominal inside diameter has been enlarged with allowances for accommodating the camber and out-of-roundness of the tube as shown and discussed above in connection with FIG. 9. And that is again, one design change which has proven workable has been by way of a non-limiting example, to enlarge the nominal inside diameter to about 2 inches (5.1 cm).

Figure 12:
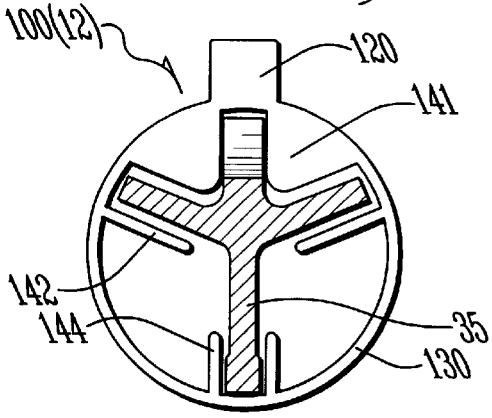
FIG. 12 is a plan view comparable to FIG. 10*a* except of additional embodiment thereof.

FIG. 12 shows an internal shape 100(12) comparable to FIG. 11 except in which the temple rails have been swollen out to become ridges 141. Observations about this design 100(12) include that the ridges 141 are much bulkier than the slender rails. This further shifts the unequal distribution of plastic bulk among the upper third of the tube 100(12) and lower two-thirds, to an even greater unbalance in favor of the upper one third of the tube 100(12). Accordingly, one would expect the upper third to cool even more slowly relative to the lower two thirds. To say that in reverse, the lower two thirds would cool even more rapidly relative to the upper third. Hence one would expect an even greater shrinkage differential, which in consequence would likely worsen the problem of camber. In brief, one would expect a tube 100(12) having the internal shape of FIG. 12 to curl in camber, flatten in out-of-roundness and warp far more than the others.

Figure 10A:
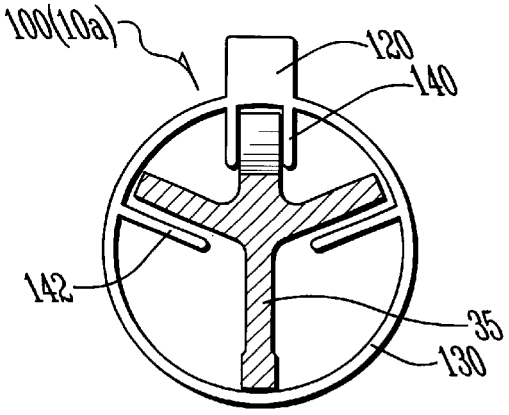
FIG. 10*a* is a reduced scale plan view comparable to FIG. 9 except showing an alternate embodiment of the plastic sheath product in accordance with the invention, and wherein the realistically-depicted studded steel T-post inside thereof is shown in section.

FIG. 10*a* shows an internal shape 100(10*a*) comparable to FIG. 11 except that the base rails have been eliminated. The viability of this shape 100(10*a*) in a 1½ inch (3.8 cm) diameter version remains subject to conjecture until tried. It is expected that the FIG. 10*a* embodiment 100(10*a*) if produced in a 2-inch (5.1 cm) diameter will less resist spinning about the T-post 35 than the FIG. 9 version which includes the base rails. Whether the FIG. 10*a* embodiment 100(10*a*) will suffice for most punishing spin-inducing environments is not known.

Figure 10B:
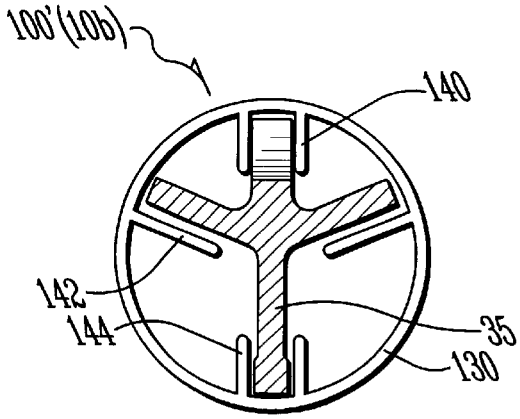
FIG. 10*b* is a plan view comparable to FIG. 10*a* except of another embodiment thereof.

FIG. 10*b* shows an internal shape 100' (10*b*) substantially the same as FIG. 11, the difference being the elimination of the spine on the outer side. This is a highly desirable shape 100' (10*b*) as a look ahead to FIGS. 21 through 26 will show. There are immediate plans to produce this embodiment 100' (10*b*) in a 2-inch (5.1 cm) version for the prototype program.

Figure 14:
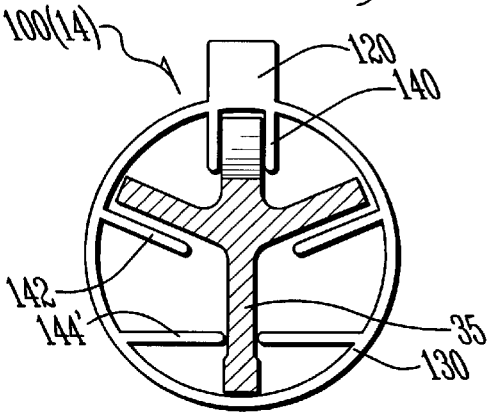
FIG. 14 is a plan view comparable to FIG. 10*a* except of still yet another embodiment thereof.
Figure 15:
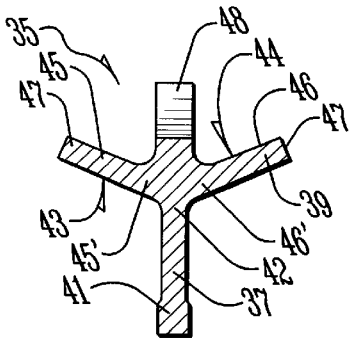
Fig. 15 ( PRIOR ART )
FIG. 15 is a representative cross-sectional view of a studded steel T-post in accordance with the prior art.

FIG. 14 shows an internal shape 100(14) comparable to FIG. 11 except that the base rails 144' have been arranged in opposition to each other rather than generally parallel. Given the current experiences with warp in the eave rails 142 (because they lie transverse to the radius of curvature of the camber), this embodiment 100(14) is expected to be similarly plagued with warp in the opposed base rails 144'.

Figure 13:
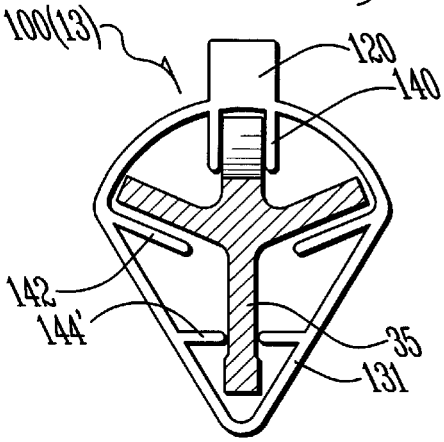
FIG. 13 is a plan view comparable to FIG. 10*a* except of a further embodiment thereof.

FIG. 13 shows an internal shape 100(13) substantially the same as FIG. 14, the difference being the changing of the tube-wall 131 shape into an arrowhead shape. This product 100(13) is believed to promise many advantages including perhaps an inherent resistance to curling in camber. This shape 100(13) may also allow elimination of the base rails 144'. To date it has not been produced and so of course has not been tested.

Figure 17:
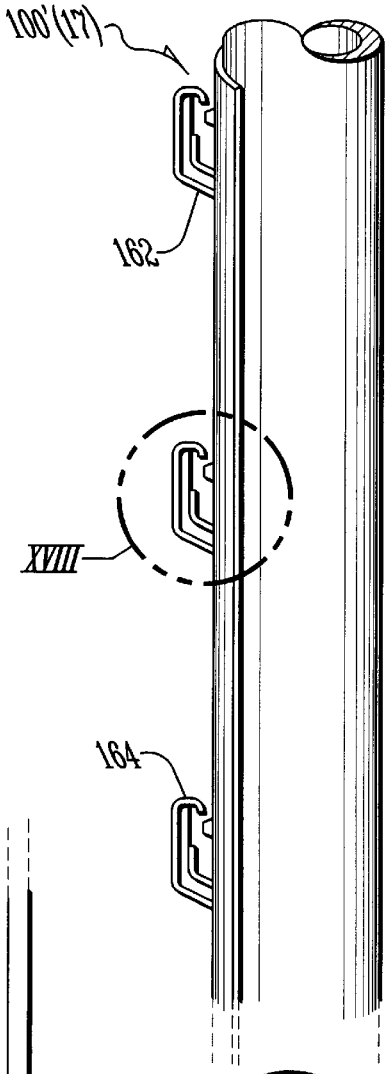
FIG. 17 is a side elevational view of yet another further embodiment of the plastic sheath product in accordance with the invention for covering studded steel T-posts.
Figure 16:
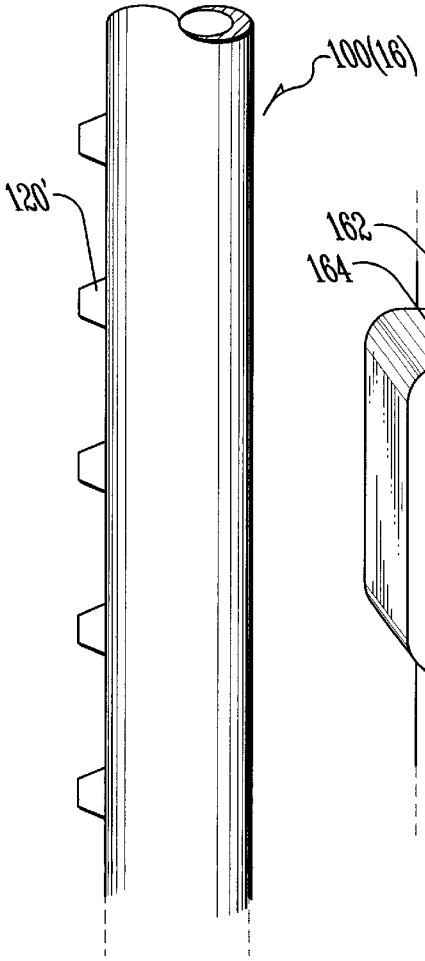
FIG. 16 is a side elevational view of another further embodiment of the plastic sheath product in accordance with the invention for covering studded steel T-posts.

FIGS. 16 and 17 show alternative embodiments for the spine of the sheath 100(16) and 100' (17). In FIG. 16, the spine 120' is formed as a series of uniformly spaced, generally triangular studs which comparably mimic the shape of the actual studs 48 on the T-post 35 itself. To refer back to FIGS. 1 and 3–5, those views show rectangular notches 121 with 2¼ inches (5.7 cm) between centers. To date these notches 121 are saw-cut by a secondary operation (eg., the relative primary or initial operation being the extrusion operation). Present plans include having the studs 120' of FIG. 16 to be formed likewise by a secondary operation. A study is planned to check the viability for forming the studs 120' during the extrusion operation at the extrusion die as perhaps by use of a recessed roller (not shown) or the like.

Figure 18:
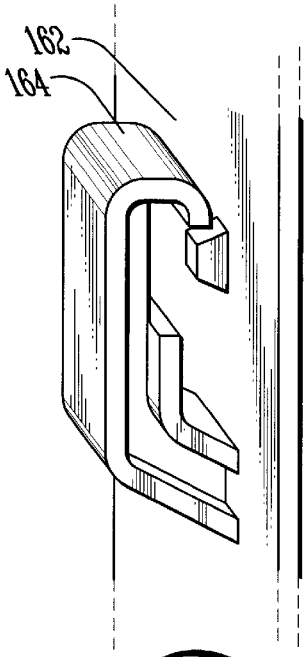
FIG. 18 is an enlarged perspective view of detail XVIII in FIG. 17.

FIG. 17 shows another embodiment for providing the outside of the sheath 100' (17) with means to prevent the sliding of fence wire 32. In this embodiment, the sheath 100' (17) is formed with a smooth outer side, and a strip 162 of clips is attached by welding or a suitable adhesive to provide the axial row of clips as shown. FIG. 18 is an enlarged perspective view of one clip 164 in isolation to show its detail, wherein the sheath 100' (17) is removed from the view.

Figure 19:
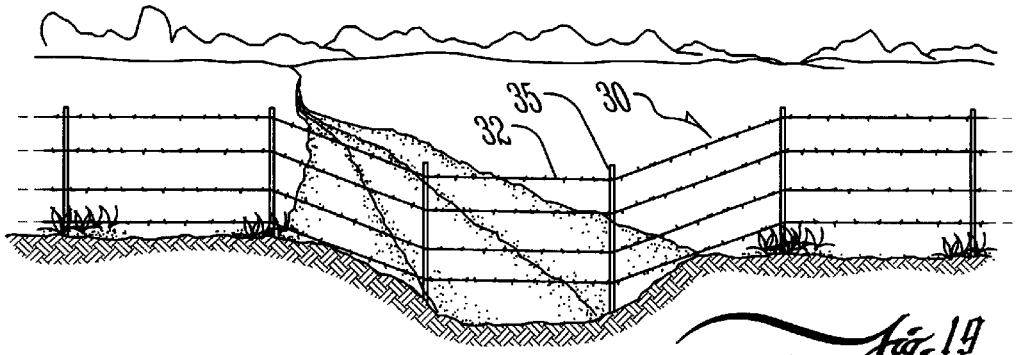
Fig. 19 ( PRIOR ART )
Figure 20:
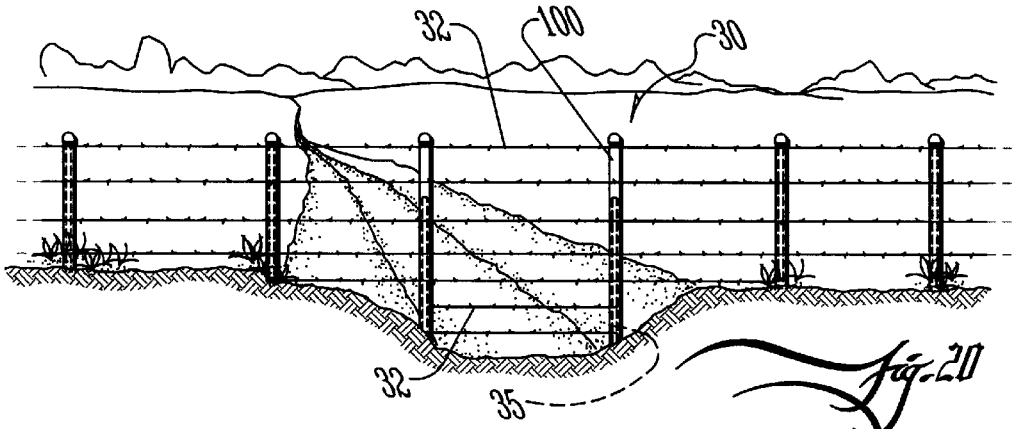
FIG. 20 is a perspective comparable to FIG. 19 except showing the studded steel T-posts of the fence line covered with the plastic sheath products in accordance with the invention to show how to run the barbed wire courses relatively more level.

The plastic sheath product 100 in accordance with the invention allows a fence installation crew (or individual) to traverse shallow ditches better than without the invention, as reference to FIGS. 19 and 20 will show. FIG. 19 shows a prior art fence 30 line of barbed-wire 32 and studded steel T-posts 35 at a place where the fence line traverses a shallow ditch dissecting a pasture or the like. It can be seen that the barbed-wire courses 32 generally dip with the contour of the ditch. FIG. 20 shows how the plastic sheath products 100 in accordance with the invention allow the fence line 30 to traverse the ditch while holding the barbed-wire courses 32 generally level. The plastic sheath products 100 are individually cut to various super-sized lengths as shown so that they all top out at about the same elevation. The upper or main four courses 32 of barbed wire are run horizontally straight across the ditch to eliminate dipping. The swale of the ditch is filled in with three lower courses 32 which have abbreviated runs as shown.

FIGS. 21 through 26 show adaptation of the plastic sheath product 100' in accordance with the invention for use with T-posts 35 in environments other than the fence environment. For example, it is known to use T-posts as sign posts. When combined with the invention, however, the sign posts are suitably dressy for uses in places where a bare T-post would be too casual. Also, the plastic sheath product 100' expands the potential use environments available to T-posts to about anything.

Figure 21:
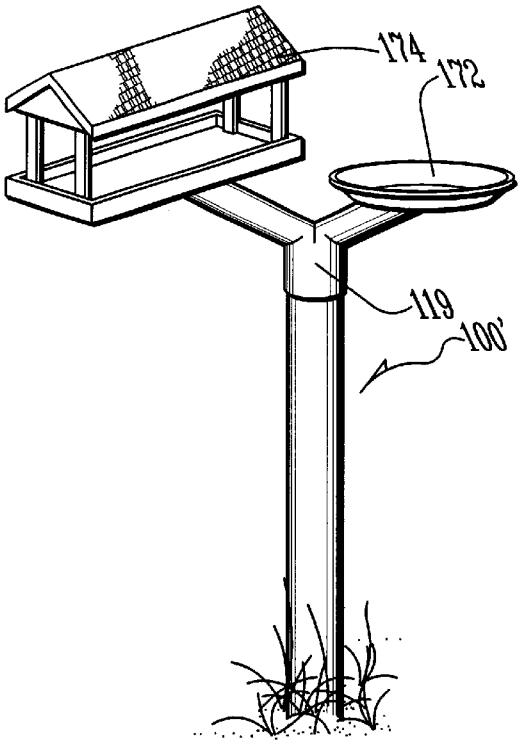
FIG. 21 is a perspective view of the plastic sheath product in accordance with the invention and most similar to the FIG. 10*b* version, it being utilized to post up a bird feeder and bird bath (wherein the supporting studded steel T-post is hidden from view)
Figure 22:
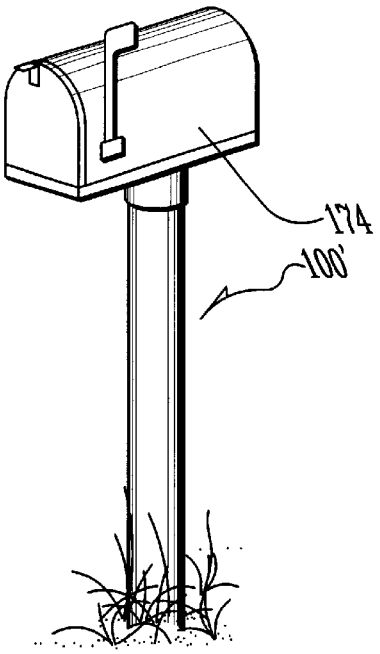
FIG. 22 is a perspective view comparable to FIG. 21 except showing the plastic sheath product utilized to post up a mailbox.
Figure 23:
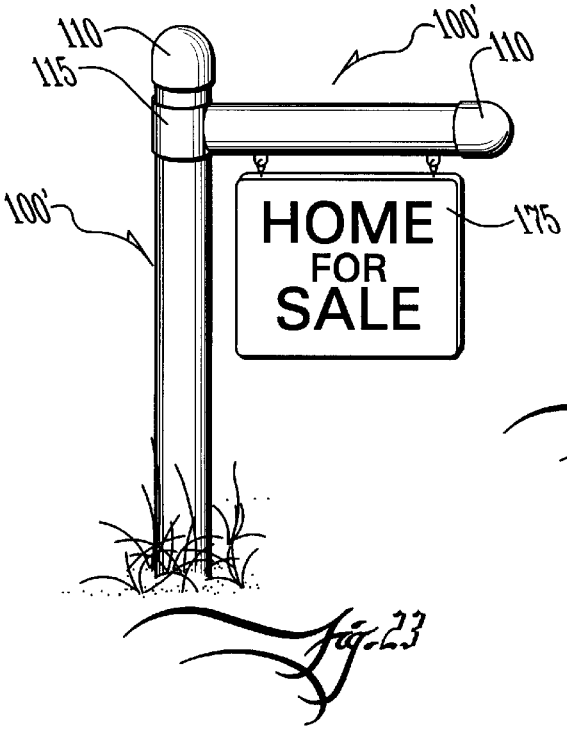
FIG. 23 is a perspective view comparable to FIG. 22 except showing the plastic sheath product in use as a sign post for an outdoor sign.

To turn to FIG. 21, it shows a sheath product 100' comparable to the spine-less FIG. 10*b* embodiment, except utilized to post up a bird feeder and bird bath 170 and 172. The supporting studded steel T-post is indeed staked in the ground but is hidden from view inside the sheath 100'. FIG. 22 shows the plastic sheath product 100' utilized as a post for a mailbox 174. FIG. 23 shows the plastic sheath product 100' in use as a sign post for a realtor's yard sign 175.

Figure 24:
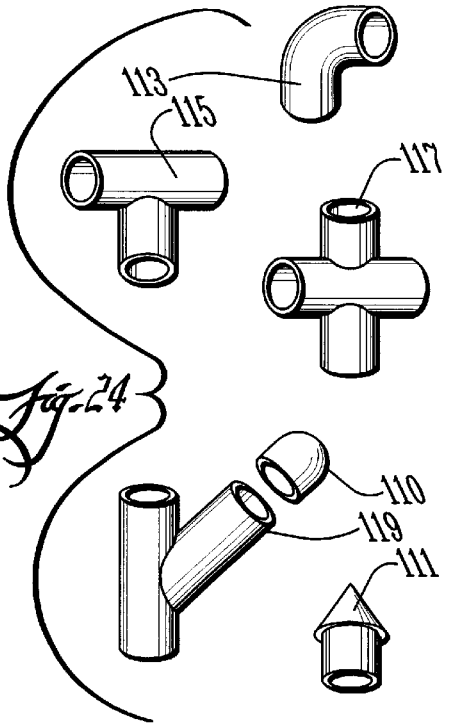

FIG. 24 is a perspective view of various alternate accessories in accordance with the invention for use with the spine-less embodiment 100' of the plastic sheath product (eg., FIG. 10*b*). These accessories include hemispheric caps 110 (see, eg., FIG. 23), conical caps 111 (see, eg., FIG. 26), and any assortment of couplings for the sheath 100', including Ell's 113 (see, eg., FIG. 25), Tee's 115 (see, eg., FIG. 24), crosses 117, and "y"-shaped splitters 119 (see, eg., FIG. 21), and so on.

Figure 25:
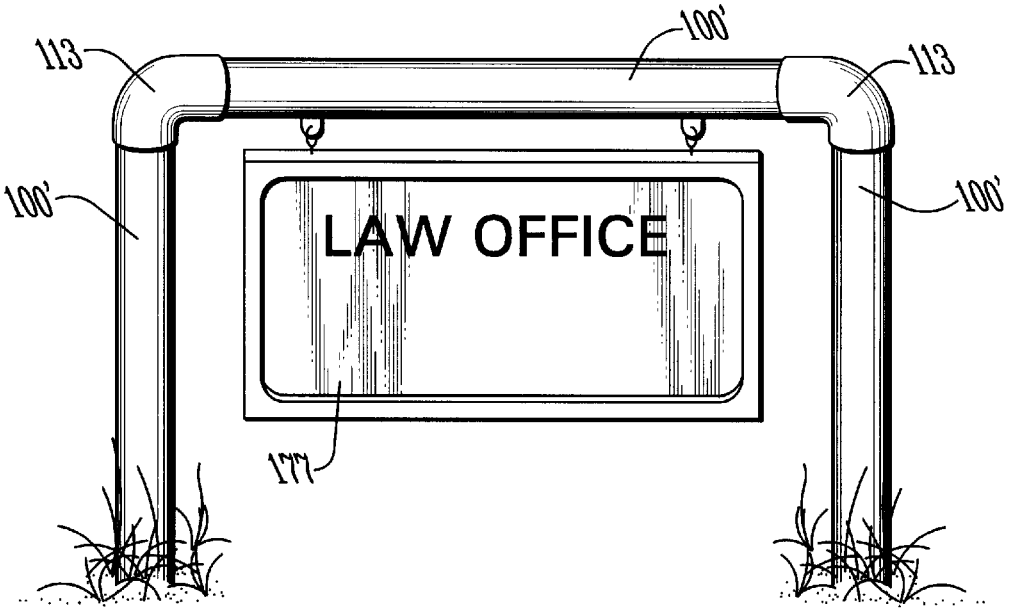
FIG. 25 is a perspective view comparable to FIG. 23 except showing a post and lintel configuration for yet another kind of outdoor sign.
Figure 26:
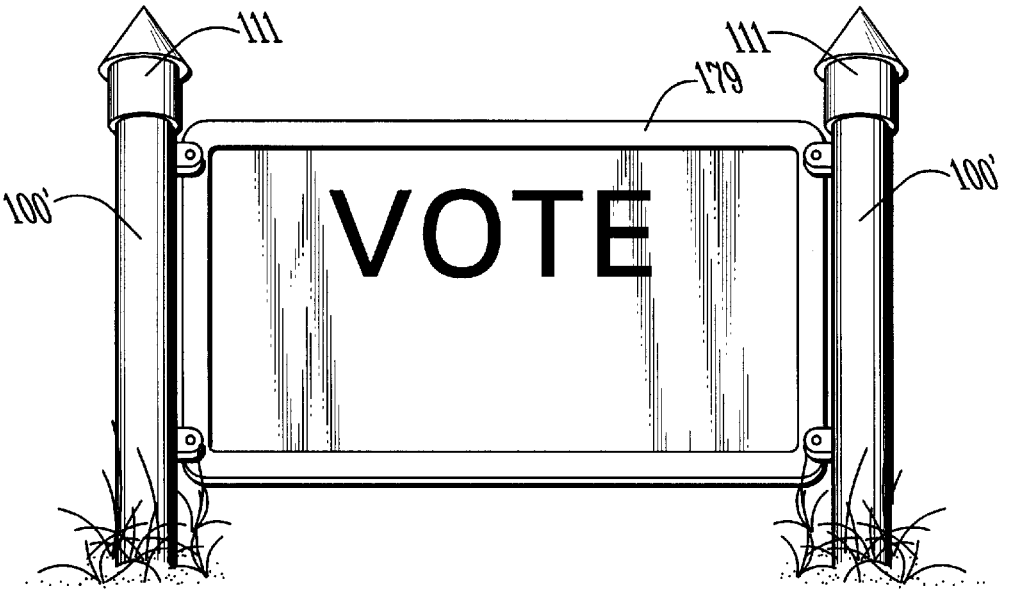
FIG. 26 is a perspective view comparable to FIG. 25 except showing a pair of posts sans lintel for a similar kind of outdoor sign.

FIGS. 25 and 26 show further sign post arrangements for the spine-less embodiment 100' of the plastic sheath product (see also FIG. 10*b*). FIG. 25 shows a post and lintel configuration for a hanging outdoor sign 177. The pair of vertical posts 100' would be telescoped over T-posts staked in the ground (hidden from view) however the lintel 100' would not incorporate an internal T-post (ie., as that would be useless in the lintel). FIG. 26 is a perspective view comparable to FIG. 25 except showing a pair of posts 100' sans lintel for another arrangement of signage, in this case a side-supported sign.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A combination studded steel T-post and an extruded plastic sheath for covering the studded steel T-post, the combination comprising:

a studded steel T-post having generally a T-shaped cross-section defined by a stem and a haunched flange having a belly side and a dorsal side, wherein the stem inserts into the belly side of the haunched flange and wherein the flange has opposite eave portions which extend from origins in the stem insertion to respective free edges, and extending down the lengthwise axial run of the dorsal side there is formed a row of generally uniformly spaced studs; and wherein said T-post the has such a size that the T-post is capable of sliding inside a hole having a nominal inside diameter D; with, an extruded plastic sheath for covering the studded steel T-post, comprising:

a tubular wall having inner and outer sides and surrounding a main lumen sized sufficiently large to allow the T-post to slide axially therein;

a series of rails which project into the lumen from origins on the inner side of the tubular wall, wherein the series of rails comprise a pair of generally parallel temple rails for defining a close-fitting slideway for the row of studs, a pair of cooperating base rails defining a close-fitting slideway for the stem of the T-post and being located generally diametrically opposite the temple rails, and, a pair of generally opposed eave rails intermediate the temple and base rails for guiding the belly sides of the opposite eaves;

wherein said tubular wall is sized to define a nominally round conduit having a nominal inside diameter in excess of 30% greater than D in order to facilitate sliding of the extrusion-produced sheath over the T-post and thereby avoid undue binding or sticking.

2. The combination of claim 1 wherein the sheath tubular wall defines such a nominally round conduit as having such an inside diameter in excess of 33% greater than the nominal measure D associated with the T-post.

3. The combination of claim 1 further comprising external means on the outer side of the tubular wall for preventing axial slipping of fence wire strapped to the sheath.

4. The combination of claim 3 wherein the external means is located generally directly outside the tubular wall from the temple rails.

5. The combination of claim 3 the external means comprises an extruded spine on the outer side of the tubular wall, said spine including slip-prevention means for preventing axial slipping of fence wire strapped to the sheath.

6. The combination of claim 5 wherein the slip-prevention means comprises one of a series of notches or a series of gaps leaving residual studs therebetween.

7. A combination studded steel T-post and an extruded plastic sheath for covering the studded steel T-post, the combination comprising:

a studded steel T-post having generally a T-shaped cross-section defined by a stem and a haunched flange having a belly side and a dorsal side, wherein the stem inserts into the belly side of the haunched flange and wherein the flange has opposite eave portions which extend from origins in the stem insertion to respective free edges, and extending down the lengthwise axial run of the dorsal side there is formed a row of generally uniformly spaced studs; and, an extruded plastic sheath for covering the studded steel T-post, comprising:

a tubular wall having inner and outer sides and surrounding a main lumen sized sufficiently large to allow the T-post to slide axially therein;

a series of internal projections which project into the lumen from origins on the inner side of the tubular wall, wherein the series of projections comprise a stud-slideway means for defining a close-fitting slideway for the row of studs, a stem-slideway means for defining a close-fitting slideway for the stem of the T-post and being located generally diametrically opposite the stud-slideway means, and, a pair of generally opposed eave-guiding means disposed intermediate the stud-slideway means and stem-slideway means for guiding the belly sides of the opposite eaves; and a spine formed on the outer side of the tubular wall and which spine, as a matter of said sheath origin's being an extruded article of production, would originally extend along the entire axial run of said sheath, wherein said spine is provided with a series of axially-spaced recessed formations while concurrently providing axial stiffening of the sheath whereby said recessed formations aid in maintenance of axial spacing among plural courses of axially-spaced fence wire that course across the sheath, which recessed formations do not breach into the main lumen in order to preserve electrical isolation of the T-post and not sever the spine.

8. The combination of claim 7 wherein the tubular wall is generally arrowhead shaped.

9. The combination of claim 7 wherein the T-post has a such a size that the T-post is capable of sliding inside nominally a hole of nominal diameter D, and wherein the sheath is sized such that the inner side of the tube wall defines a nominally round conduit having an inside diameter between about at least 5 and 10% greater than the nominal measure D.

10. The combination of claim 7 wherein the recessed formations of the spine on the outer side of the tubular wall comprise one of a series of notches or a series of gaps leaving residual studs therebetween.

11. The combination of claim 7 wherein the tubular wall is generally round.

12. A combination studded steel T-post and an extruded plastic sheath for covering the studded steel T-post, the combination comprising:

a studded steel T-post having generally a T-shaped cross-section defined by a stem and a haunched flange having a belly side and a dorsal side, wherein the stem inserts into the belly side of the haunched flange and wherein the flange has opposite eave portions which extend from origins in the stem insertion to respective free edges, and extending down the lengthwise axial run of the dorsal side there is formed a row of generally uniformly spaced studs; and wherein said T-post the has such a size that the T-post is capable of sliding inside a hole having a nominal inside diameter D; and, an extruded plastic sheath for covering the studded steel T-post, comprising:

a tubular wall having inner and outer sides and surrounding a main lumen sized sufficiently large to allow the T-post to slide axially therein;

a series of internal projections which project into the lumen from origins on the inner side of the tubular wall, wherein the series of projections comprise a stud-slideway means for defining a close-fitting slideway for the row of studs, and a stem-slideway means for defining a close-fitting slideway for the stem of the T-post and being located generally diametrically opposite the stud-slideway means;

wherein said tubular wall is sized to define a nominally round conduit having a nominal inside diameter in excess of 30% greater than D in order to facilitate sliding of the extrusion-produced sheath over the T-post and thereby avoid undue binding or sticking.

13. The combination of claim 12 further comprising external means on the outer side of the tubular wall for preventing axial slipping of fence wire strapped to the sheath.

14. The combination of claim 13 the external means comprises an extruded spine on the outer side of the tubular wall which is located generally directly outside the tubular wall from the stud-slideway means, said spine including slip-prevention means for preventing axial slipping of fence wire strapped to the sheath comprising one of a series of notches or a series of gaps leaving residual studs therebetween.

15. A combination studded steel T-post and an extruded plastic sheath for covering the studded steel T-post, the combination comprising:

a studded steel T-post having generally a T-shaped cross-section defined by a stem and a haunched flange having a belly side and a dorsal side, wherein the stem inserts into the belly side of the haunched flange and wherein the flange has opposite eave portions which extend from origins in the stem insertion to respective free edges, and extending down the lengthwise axial run of the dorsal side there is formed a row of generally uniformly spaced studs; and, an extruded plastic sheath for covering the studded steel T-post, comprising:

a tubular wall having inner and outer sides and surrounding a main lumen sized sufficiently large to allow the T-post to slide axially therein;

a series of internal projections which project into the lumen from origins on the inner side of the tubular wall, wherein the series of projections comprise a stud-slideway means for defining a close-fitting slideway for the row of studs, a pair of generally opposed eave-guiding means disposed approximately diametrically transverse to the stud-slideway means and for guiding the belly sides of the opposite eaves; and a spine formed on the outer side of the tubular wall and which spine, as a matter of said sheath origin's being an extruded article of production, would originally extend along the entire axial run of said sheath, wherein said spine is provided with a series of axially-spaced recessed formations while concurrently providing axial stiffening of the sheath whereby said recessed formations aid in maintenance of axial spacing among plural courses of axially-spaced fence wire that course across the sheath, which recessed formations do not breach into the main lumen in order to preserve electrical isolation of the T-post and not sever the spine.

16. The combination of claim 15 wherein the is located generally directly outside the tubular wall from the stud-slideway means.

* * * * *